US006425457B1

(12) United States Patent
Lundry

(10) Patent No.: US 6,425,457 B1
(45) Date of Patent: Jul. 30, 2002

(54) COLLAPSIBLE STEP ASSEMBLY

(76) Inventor: Rick L. Lundry, 5821 Quail Meadows, Poplar Bluff, MO (US) 63901

( * ) Notice: Subject to any disclaimer, the term of this patent is extended or adjusted under 35 U.S.C. 154(b) by 0 days.

(21) Appl. No.: 09/860,332

(22) Filed: May 18, 2001

(51) Int. Cl.[7] ..... E06C 1/00; E04G 3/00; A47B 83/00

(52) U.S. Cl. ..... 182/35; 182/88; 312/235.1

(58) Field of Search ..... 182/35, 20, 88; 312/278, 330.1, 279, 235.1, 235.3, 334.1, 228, 228.1

(56) References Cited

U.S. PATENT DOCUMENTS

| | | | | | |
|---|---|---|---|---|---|
| 580,625 | A | * | 4/1897 | Roberts | 312/278 |
| 1,681,879 | A | * | 8/1928 | Putnam | 182/33.5 |
| 2,622,658 | A | * | 12/1952 | Morgan | 182/35 X |
| 2,881,040 | A | | 4/1959 | Hartridge | |
| 3,311,190 | A | * | 3/1967 | Naumann | 182/88 X |
| 4,135,604 | A | | 1/1979 | Ryan | |
| 4,846,304 | A | | 7/1989 | Rasmussen | |
| 5,005,667 | A | | 4/1991 | Anderson | |
| 5,009,282 | A | * | 4/1991 | Willsher | 182/88 |
| 5,228,707 | A | * | 7/1993 | Yoder | 182/88 X |
| 5,341,897 | A | | 8/1994 | Gross | |
| D360,767 | S | | 8/1995 | Fish et al. | |
| 5,660,405 | A | * | 8/1997 | Campbell | 182/88 X |
| 5,755,498 | A | * | 5/1998 | Cutler | 312/235.1 |

* cited by examiner

*Primary Examiner*—Daniel P. Stodola
*Assistant Examiner*—Hugh B. Thompson

(57) ABSTRACT

A collapsible step assembly for storing in a drawer of a cabinet. The collapsible step assembly includes a staircase for ascending and descending from a surface. The staircase includes a first end and a second end. A drawer assembly is provided for pivotally storing the staircase under the cabinet. The drawer assembly includes a drawer that has an interior. The second end of the staircase is pivotally coupled to the drawer between an extended position and a retracted position, In one embodiment of the present invention, the extended position is characterized by the staircase extending outwardly through an opening in the drawer. The retracted position is characterized by the staircase lying in the interior of the drawer. A bracket assembly is pivotally coupled to the staircase for supporting the staircase in the extended position.

12 Claims, 5 Drawing Sheets

5
12
25
40
10
24
5

COLLAPSIBLE STEP ASSEMBLY

BACKGROUND OF THE INVENTION

1. Field of the Invention

The present invention relates to collapsible steps and more particularly pertains to a new collapsible step assembly for storing in a drawer of a cabinet.

2. Description of the Prior Art

The use of collapsible steps is known in the prior art. More specifically, collapsible steps heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,005,667; U.S. Pat. No. 5,341,897; U.S. Pat. No. 2,881,040; U.S. Pat. No. Des. 360,767; U.S. Pat. No. 4,135,604; and U.S. Pat. No. 4,846,304.

While these devices fulfill their respective, particular objectives and requirements, the aforementioned patents do not disclose a new collapsible step assembly. The inventive device includes a staircase for ascending and descending from a surface. The staircase includes a first end and a second end. A drawer assembly is provided for pivotally storing the staircase under the cabinet. The drawer assembly includes a drawer that has an interior. The second end of the staircase is pivotally coupled to the drawer between an extended position and a retracted position, In one embodiment of the present invention, the extended position is characterized by the staircase extending outwardly through an opening in the drawer. The retracted position is characterized by the staircase lying in the interior of the drawer. A bracket assembly is pivotally coupled to the staircase for supporting the staircase in the extended position.

In these respects, the collapsible step assembly according to the present invention substantially departs from the conventional concepts and designs of the prior art, and in so doing provides an apparatus primarily developed for the purpose of storing in a cabinet having a front wall.

SUMMARY OF THE INVENTION

In view of the foregoing disadvantages inherent in the known types of collapsible steps now present in the prior art, the present invention provides a new collapsible step assembly construction wherein the same can be utilized for storing in a drawer of a cabinet.

The general purpose of the present invention, which will be described subsequently in greater detail, is to provide a new collapsible step assembly apparatus and method which has many of the advantages of the collapsible steps mentioned heretofore and many novel features that result in a new collapsible step assembly which is not anticipated, rendered obvious, suggested, or even implied by any of the prior art collapsible steps, either alone or in any combination thereof.

To attain this, the present invention generally comprises a staircase for ascending and descending from a surface. The staircase includes a first end and a second end. A drawer assembly is provided for pivotally storing the staircase under the cabinet. The drawer assembly includes a drawer that has an interior. The second end of the staircase is pivotally coupled to the drawer between an extended position and a retracted position, In one embodiment of the present invention, the extended position is characterized by the staircase extending outwardly through an opening in the drawer. The retracted position is characterized by the staircase lying in the interior of the drawer. A bracket assembly is pivotally coupled to the staircase for supporting the staircase in the extended position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new collapsible step assembly apparatus and method which has many of the advantages of the collapsible steps mentioned heretofore and many novel features that result in a new collapsible step assembly which is not anticipated, rendered obvious, suggested, or even implied by any of the prior art collapsible steps, either alone or in any combination thereof.

It is another object of the present invention to provide a new collapsible step assembly which may be easily and efficiently manufactured and marketed.

It is a further object of the present invention to provide a new collapsible step assembly which is of a durable and reliable construction.

An even further object of the present invention is to provide a new collapsible step assembly which is susceptible of a low cost of manufacture with regard to both materials and labor, and which accordingly is then susceptible of low prices of sale to the consuming public, thereby making such collapsible step assembly economically available to the buying public.

Still yet another object of the present invention is to provide a new collapsible step assembly which provides in the apparatuses and methods of the prior art some of the advantages thereof, while simultaneously overcoming some of the disadvantages normally associated therewith.

Still another object of the present invention is to provide a new collapsible step assembly for storing in a drawer of a cabinet.

Yet another object of the present invention is to provide a new collapsible step assembly which includes a staircase for ascending and descending from a surface. The staircase includes a first end and a second end. A drawer assembly is provided for pivotally storing the staircase under the cabinet. The drawer assembly includes a drawer that has an interior.

The second end of the staircase is pivotally coupled to the drawer between an extended position and a retracted position, In one embodiment of the present invention, the extended position is characterized by the staircase extending outwardly through an opening in the drawer. The retracted position is characterized by the staircase lying in the interior of the drawer. A bracket assembly is pivotally coupled to the staircase for supporting the staircase in the extended position.

Still yet another object of the present invention is to provide a new collapsible step assembly that unlike the prior art, which employed movable steps to create a staircase, employs a staircase with substantially rigid steps thereby reducing the likelihood of injury due from one of the steps moving with respect to the other steps of the staircase.

Even still another object of the present invention is to provide a new collapsible step assembly that, unlike the prior, employs a narrower staircase allowing to more compactly fit in a cabinet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
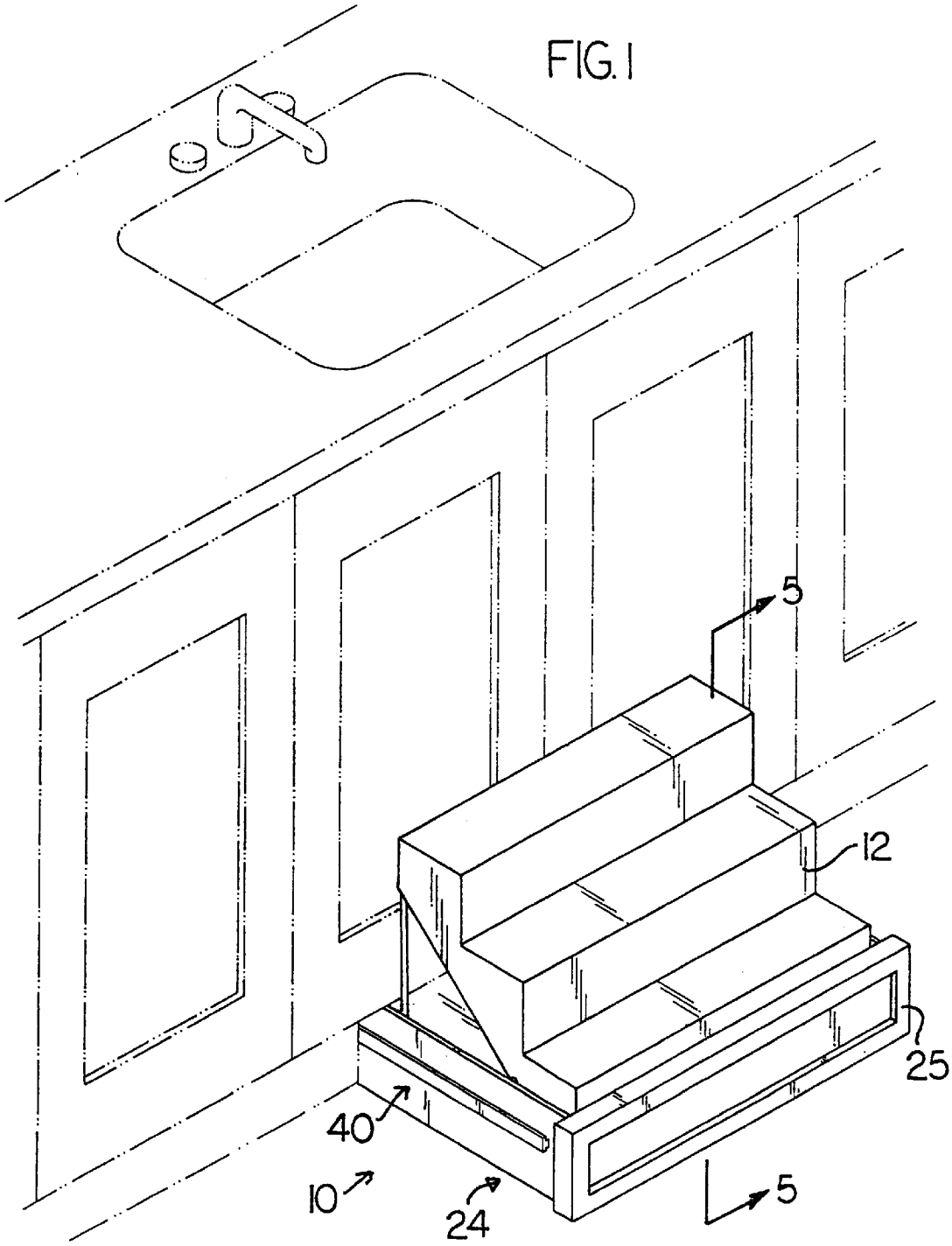
FIG. 1 is a schematic perspective view of a new collapsible step assembly according to the present invention.
Figure 2:
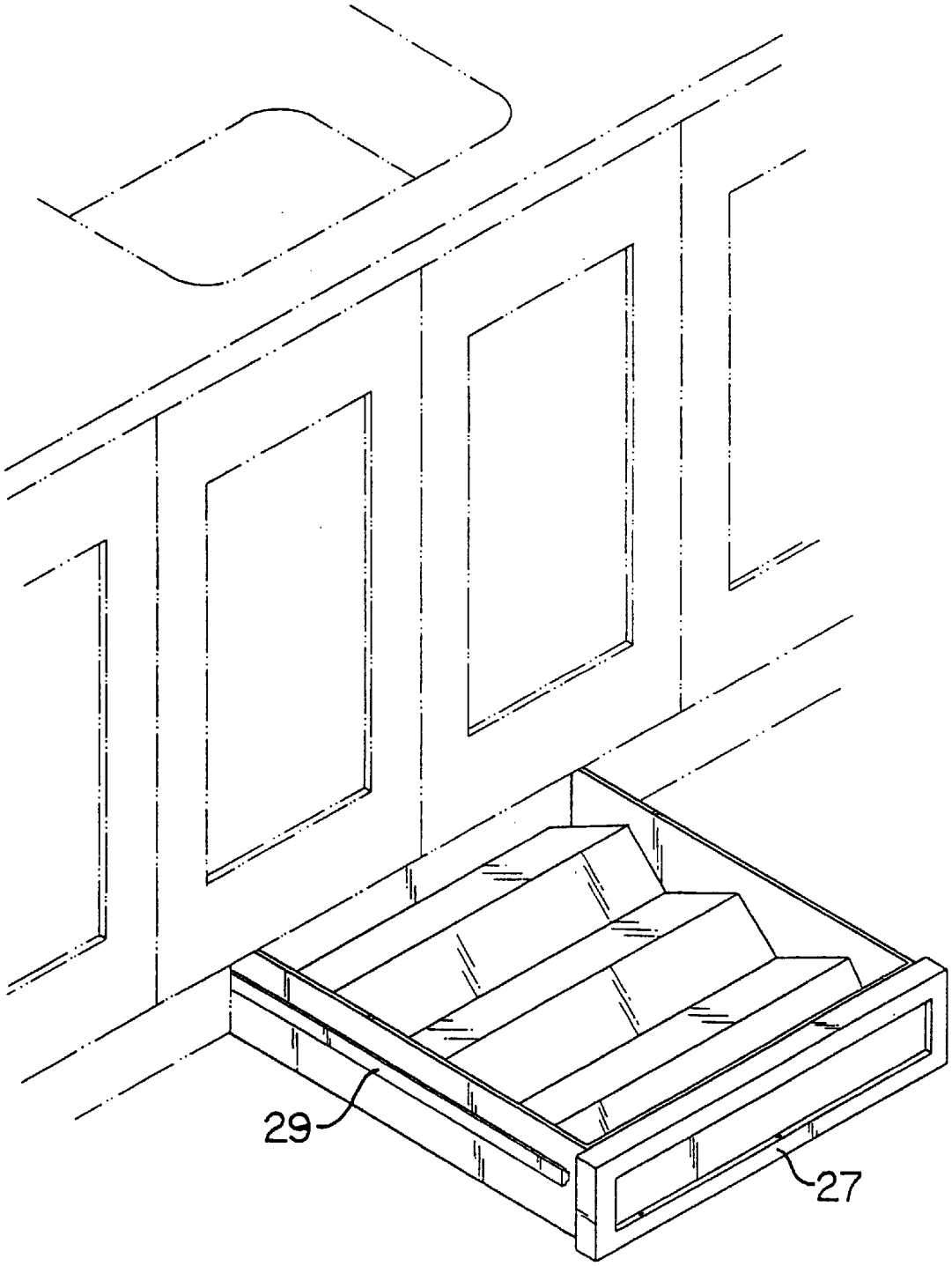
FIG. 2 is a schematic perspective view of the present invention showing the present invention in a retracted position.
Figure 3:
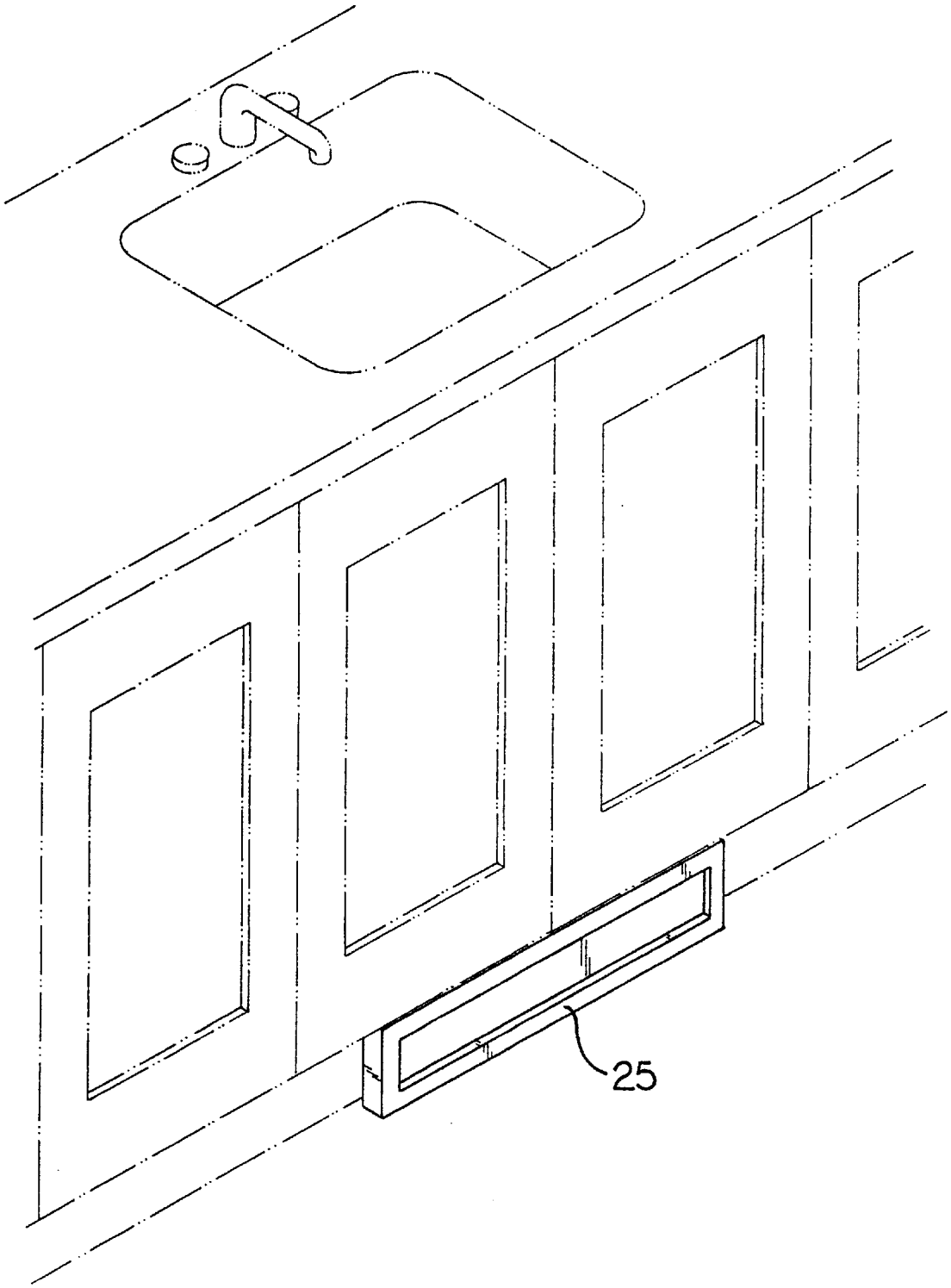
FIG. 3 is a schematic perspective view of the present invention showing the present invention in a cabinet.
Figure 4:
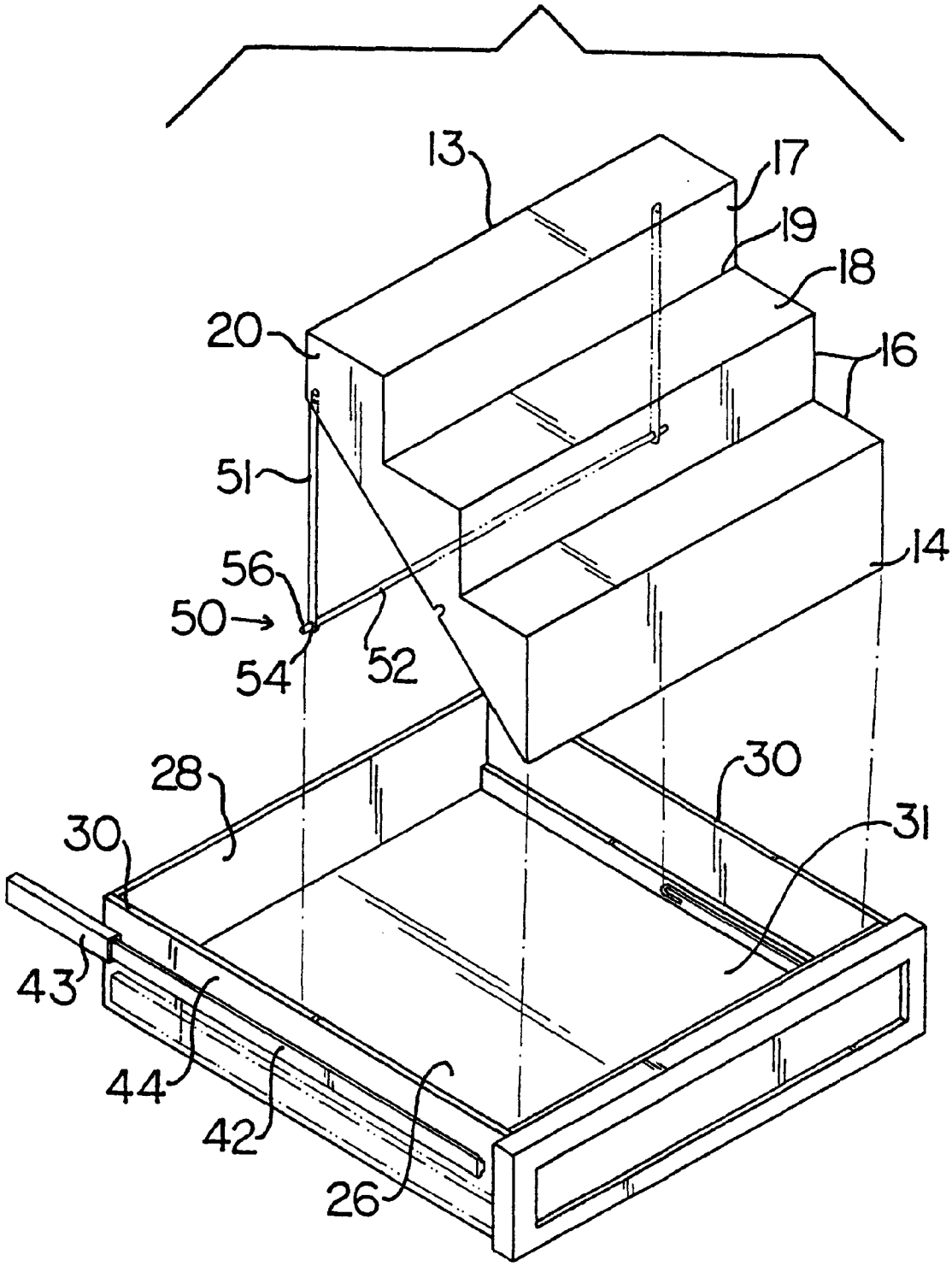
FIG. 4 is a schematic exploded view of the present invention.

With reference now to the drawings, and in particular to FIGS. 1 through 5 thereof, a new collapsible step assembly embodying the principles and concepts of the present invention and generally designated by the reference numeral 10 will be described.

As best illustrated in FIGS. 1 through 5, the collapsible step assembly 10 generally comprises a staircase 12 for ascending and descending from a surface. The staircase 12 includes a first end 13 and a second end 14. The staircase 12 may include a plurality of steps 16 with each of the steps 16 including a riser portion 17 and a tread portion 18 coupled together. An edge 19 of each of the riser portions 17 is coupled to and extends between a pair of the tread portions 18. Each of the riser portions 17 may be orientated generally perpendicular to each of the tread portions 18. The staircase 12 may employ any number of steps 16.

The staircase 12 may also include a pair of side walls 20 extending from each of the riser 17 and tread 18 portions. An edge 21 of each of the side walls 20 may include a notch 22 extending therein. Each of the notches 22 may positioned generally nearer the second end 14 than the first end 13 of the staircase 12.

A drawer assembly 24 is provided for pivotally storing the staircase 12 under the cabinet. The drawer assembly 24 includes a drawer 25 that has a bottom wall 26, a front wall 27, a back wall 28 and a pair of side walls 29 extending between the front 27 and back 28 walls. The drawer 25 includes an open top 30 extending into an interior 31 of the drawer 25. The second end 14 of the staircase 12 may be pivotally coupled to the pair of side walls 29 of the drawer 25 between an extended position and a retracted position.

In one embodiment of the present invention, the extended position is characterized the staircase 12 extending outwardly through the opening 30 in the drawer 25. The retracted position is characterized by the staircase 12 lying in the interior 31 of the drawer 25. Each of the side walls 29 of the drawer 25 may include a groove 34 extending therein. Each of the grooves 34 preferably extend from the front wall 27 toward the back wall 28 of the drawer 25. Each of the grooves 34 is preferably orientated generally parallel to the bottom wall 26 of the drawer 25. Each of the grooves 34 may include a bend 35 therein such that an end portion 36 of each of the grooves 34 is positioned generally between an intermediate portion 37 of each of the grooves 34 and the bottom wall 26 of the drawer 25.

A track assembly 40 may be provided for slidably positioning the drawer 25 under the cabinet. The track assembly 40 may include a pair of first track portions 42 and a pair of second track portions 43. The pair of first track portions 42 may be mounted on an outer surface 44 of each of the side walls 29 of the drawer 25. Each of the first track portions 42 preferably extend between the front 27 and back 28 walls of the drawer 25. Each of the second track portions 43 may be mountable on an inner surface of the cabinet. In one embodiment of the present invention, as particularly illustrated in FIG. 4, each of the first track portions 42 is slidably mounted in the one of the second track portions 43.

A bracket assembly 50 is pivotally coupled to the staircase 12 for supporting the staircase 12 in the extended position. The bracket assembly 50 may include a pair of elongated support rods 51 and a connecting rod 52. In one embodiment of the present invention, as particularly illustrated in FIGS. 4 and 5, each of the support rods 51 is pivotally coupled to one of the side walls 20 of the staircase 12. Each of the support rods 51 may be positioned generally adjacent to the first end 13 of the staircase 12. A longitudinal axis of each of the support rods 51 is preferably orientated generally perpendicular to the bottom wall 26 of the drawer 25 when the staircase 12 is in the extended position. The longitudinal axis of each of the support rods 51 may be orientated generally parallel to the bottom wall 25 of the drawer 25 when the staircase 12 is in the retracted position.

Figure 5:
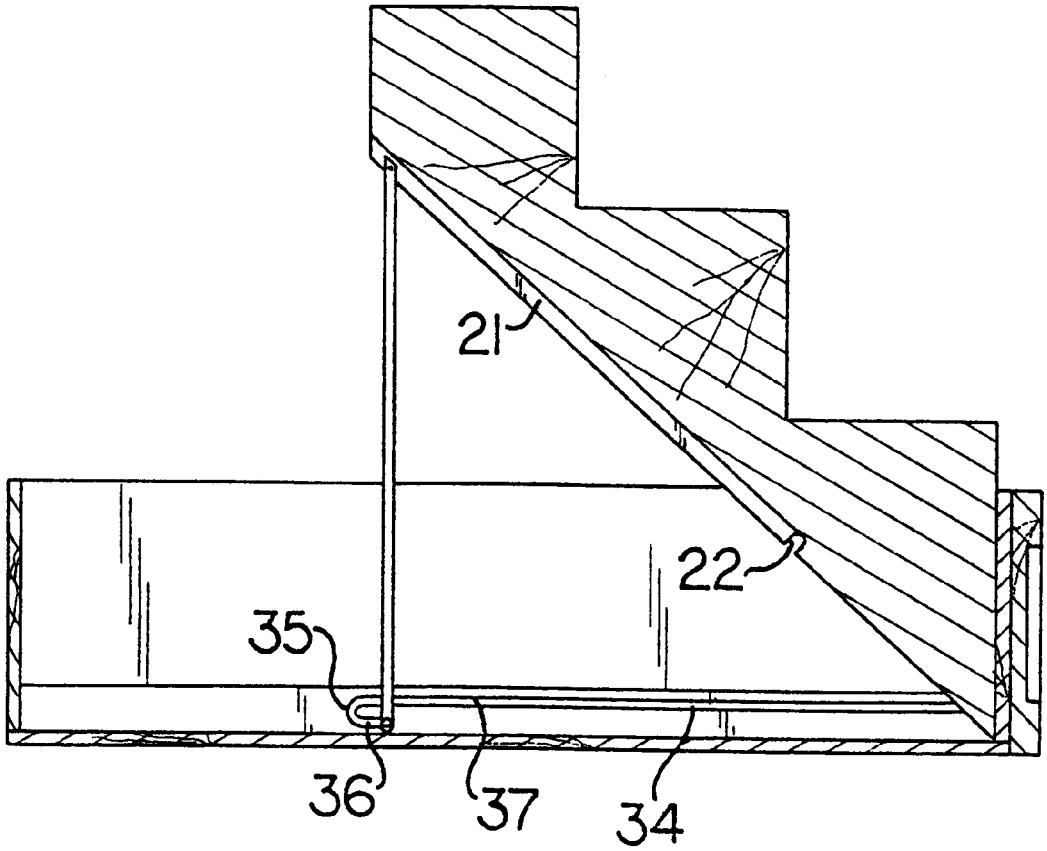
FIG. 5 is a schematic cross-sectional view of the present invention taken along line 5—5 of FIG. 1.

In one embodiment of the present invention, the connecting rod 52 extends between an end 54 of each of the support rods 51 for supporting each of the ends 54 of the support rods 51. The connecting rod 52 may include a pair of ends 56 extending beyond each of the support rods 51. Each of the ends 56 of the connecting rod 52 may be slidably mounted in one of the grooves 34 of the side walls 29 of the drawer 25. As illustrated in FIG. 5, each of the ends 56 of the connecting rod 52 may be position in the end portion 36 of each of the grooves 34 when the staircase 12 is in the extended position. The connecting rod 52 may be positioned generally adjacent to the front wall 27 of the drawer 25 when the staircase 12 is in the retracted position.

In use, the drawer 25 is pulled out from the cabinet so that the user may place the staircase 12 in the extended position, which allows a user to ascend the steps 16 of the staircase 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible step assembly for storing in a drawer of a cabinet, said assembly including:

a staircase for ascending and descending from a surface, said staircase having a first end and a second end;

a drawer assembly for pivotally storing said staircase under the cabinet, said drawer assembly including a drawer having an interior, said second end of said staircase being pivotally coupled to said drawer between an extended position and a retracted position, wherein said extended position is characterized said staircase extending outwardly through an opening in said drawer, wherein said retracted position is characterized by said staircase lying in said interior of said drawer; and a bracket assembly being pivotally coupled to said staircase for supporting said staircase in said extended position, said bracket assembly including a pair of elongated support rods coupled to said staircase and to a connecting rod extending between a lower end of said support rods.

2. The collapsible step assembly of claim 1, wherein said staircase includes a plurality of steps, each of said steps having a riser portion and a tread portion coupled together.

3. The collapsible step assembly of claim 2, wherein an edge of each of said riser portions is coupled to and extending between a pair of said tread portions, each of said riser portions being orientated generally perpendicular to each of said tread portions.

4. The collapsible step assembly of claim 2, wherein said staircase has a pair of side walls extending from each of said riser and tread portions, said bracket assembly being coupled to each of said side walls.

5. The collapsible step assembly of claim 1, additionally including a track assembly being mounted on said drawer for slidably positioning said drawer under the cabinet.

6. The collapsible step assembly of claim 5, wherein said track assembly includes a first track portion and a second track portion, said first track portion being mounted on an outer surface of a pair of side walls of said drawer, said second track portion being mountable on an inner surface of the cabinet, wherein said first track portion is slidably mounted in said second track portion.

7. The collapsible step assembly of claim 1, wherein each of said support rods is pivotally coupled to a respective one of a pair of side walls of said staircase.

8. The collapsible step assembly of claim 7, wherein a longitudinal axis of each of said support rods is orientated generally perpendicular to said bottom wall of said drawer when said staircase is in an extended position with respect to said drawer, said longitudinal axis of each of said rods being orientated generally parallel to said bottom wall of said when said staircase is in a retracted position with respect to said drawer.

9. The collapsible step assembly of claim 1, wherein a pair of ends of said connecting rod extend beyond each of said support rods, each of said ends of said connecting rod being slidably mounted in one of a pair of side walls of said drawer.

10. The collapsible step assembly of claim 9, wherein each of said side walls of said drawer has a groove extending therein, each of said ends of said connecting rod being positioned in one of said grooves.

11. The collapsible step assembly of claim 10, wherein each of said grooves has a bend therein such that an end portion of each of said grooves is positioned generally between an intermediate portion of each of said grooves and a bottom wall of said drawer, said ends of said connecting rod being positioned in said end portion of said groove when said staircase is in an extended position with respect to said drawer, each of said ends of said connecting rod being positioned in a pair of notches extending into a pair of side walls of said staircase when said staircase is in a retracted position with respect to said drawer.

12. A collapsible step assembly for storing in a drawer of a cabinet, said assembly including:

a staircase for ascending and descending from a surface, said staircase having a first end and a second end, said staircase including a plurality of steps, each of said steps having a riser portion and a tread portion coupled together, an edge of each of said riser portions being coupled to and extending between a pair of said tread portions, each of said riser portions being orientated generally perpendicular to each of said tread portions, said staircase having a pair of side walls extending from each of said riser and tread portions, an edge of each of said side walls having a notch extending therein, each of said notches being positioned generally nearer said second end than said first end of said staircase;

a drawer assembly for pivotally storing said staircase under the cabinet, said drawer assembly including:

a drawer having a bottom wall, a front wall, a back wall and a pair of side walls extending between said front and back walls, said drawer having an open top extending into an interior of said drawer, said second end of said staircase being pivotally coupled to said pair of side walls of said drawer between an extended position and a retracted position, wherein said extended position is characterized said staircase extending outwardly through said opening in said drawer, wherein said retracted position is characterized by said staircase lying in said interior of said drawer, each of said side walls of said drawer having a groove extending therein, each of said grooves extending from said front wall toward said back wall of said drawer, each of said grooves being orientated generally parallel to said bottom wall of said housing, each of said grooves having a bend therein such that an end portion of said grooves is positioned generally between a an intermediate portion of said groove and said bottom wall of said drawer;

a track for slidably positioning said drawer under the cabinet, said track assembly including a first track portion and a second track portion, said first track portion being mounted on an outer surface of each of said side walls of said drawer, each of said first track portions extending between said front and back walls of said drawer, said second track portion being mountable on an inner surface of the cabinet, wherein said first track portion is slidably mounted in said second track portion;

a bracket assembly being pivotally coupled to said staircase for supporting said staircase in said extended position, said bracket assembly including a pair of elongated support rods and a connecting rod;

wherein each of said support rods is pivotally coupled to a respective one of said side walls of said staircase, each of said support rods being positioned generally adjacent to said first end of said staircase, a longitudinal axis of each of said support rods being orientated generally perpendicular to said bottom wall of said drawer when said staircase is in said extended position, said longitudinal axis of each of said rods being orientated generally parallel to said bottom wall of said when said staircase is in said retracted position; and wherein said connecting rod extends between an end of each of said support rods for supporting each of said ends of said support rods, said connecting rod having a pair of ends extending beyond each of said support roads, each of said ends of said connecting rod being slidably mounted in one of said grooves of said side walls of said drawer, each of said ends of said connecting rod being position in said end of each of said grooves when said stairs are in said extended position, said connecting rod being positioned generally adjacent to said front wall of said drawer when said staircase is in said retracted position.

* * * * *